United States Patent [19]

Melin

[11] 4,399,993

[45] Aug. 23, 1983

[54] TWO HANDED TENNIS RACKET

[76] Inventor: Arthur K. Melin, 457 Country Club Dr., San Gabriel, Calif. 91778

[21] Appl. No.: 293,386

[22] Filed: Aug. 17, 1981

Related U.S. Application Data

[63] Continuation of Ser. No. 55,322, Jul. 6, 1979, abandoned.

[51] Int. Cl.[3] ..... A63B 49/08

[52] U.S. Cl. ..... 273/73 R; 273/73 J; 273/75

[58] Field of Search ..... 273/73 R, 73 C, 73 D, 273/73 H, 73 J, 75

[56] References Cited

U.S. PATENT DOCUMENTS

| | | | |
|---|---|---|---|
| 3,515,386 | 6/1970 | Mason | 273/73 R |
| 3,833,219 | 9/1974 | Dean | 273/73 J X |
| 3,999,756 | 12/1976 | Head | 273/73 C |
| 4,196,901 | 4/1980 | Durbin | 273/73 G |

FOREIGN PATENT DOCUMENTS

| | | | |
|---|---|---|---|
| 2717 | of 1909 | United Kingdom | 273/73 C |
| 310350 | 4/1929 | United Kingdom | 273/73 C |

OTHER PUBLICATIONS

"The Philadelphia Inquirer: Sports"; Jun. 1978.
"The Sporting Goods Dealer"; May 1975; p. 156.

*Primary Examiner*—Anton O. Oechsle
*Attorney, Agent, or Firm*—Christie, Parker & Hale

[57] ABSTRACT

A sports racket having a handle portion and grip that is longer in length and equal to or smaller in diameter than a conventional racket so as to provide a racket which can be swung with a two-handed grip when hitting either a forehand or a backhand shot. The grip has an overall length equal to or greater than three hand widths of the player using the racket.

3 Claims, 6 Drawing Figures

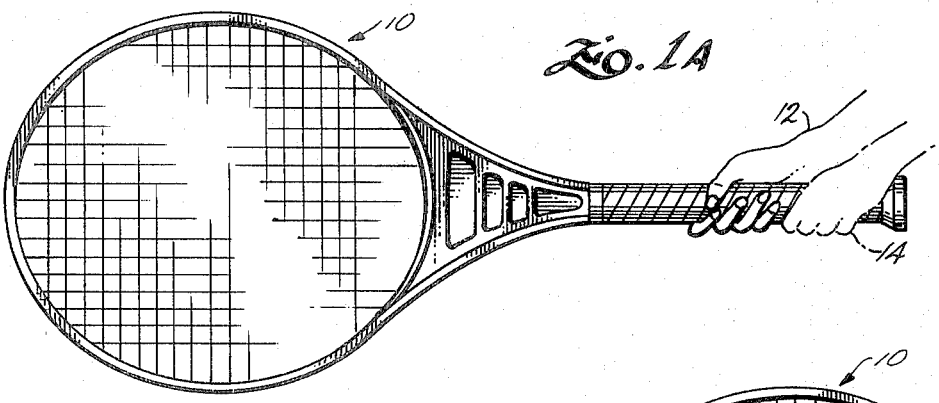
Fig. 1A
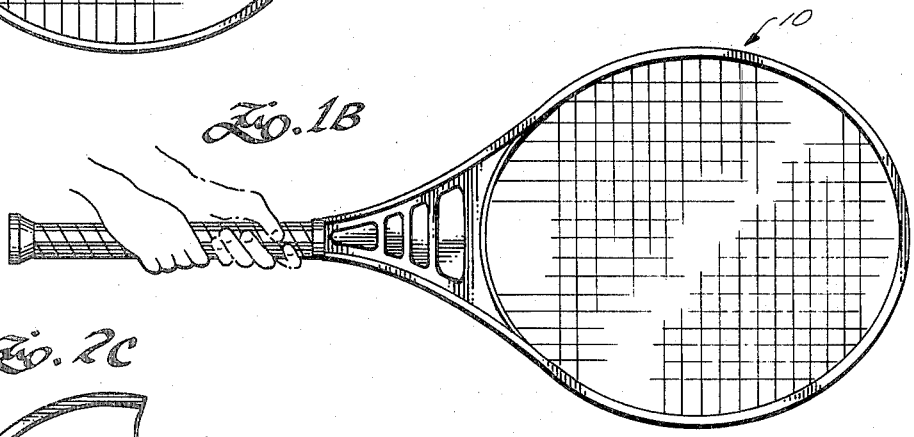
Fig. 1B
Fig. 2C
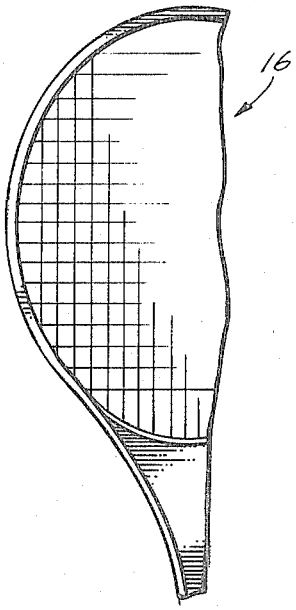
Fig. 2A
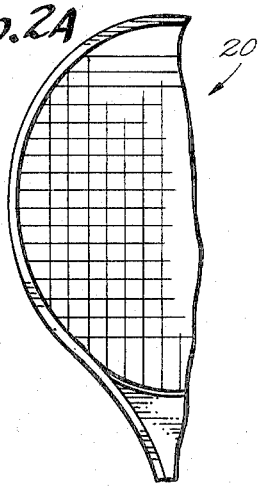
Fig. 2B
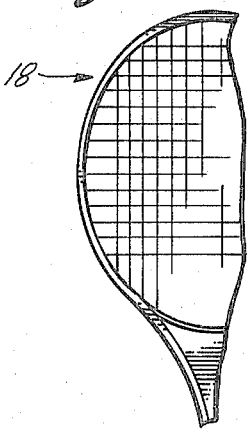

TWO HANDED TENNIS RACKET

CROSS REFERENCE TO RELATED APPLICATIONS

This is a continuation of application Ser. No. 055,322, filed July 6, 1979, abandoned.

BACKGROUND OF THE INVENTION

The present invention relates to rackets and in particular to tennis rackets having a greater overall length and an elongated handle and grip to permit the gripping of the racket in a two-handed grip when hitting either a forehand or a backhand shot without the necessity of the player having to shift the position of both hands on the racket when changing from a forehand to a backhand shot.

As the popularity of the game of tennis continues it is becoming more and more apparent that the physical capacities and limitations of various types of players dictate that conventional rackets and conventional strokes are not necessarily suitable for all players. As an example, it has now become acceptable and quite common to see players execute the backhand stroke using a two handed grip. Typically the reason for resorting to a two handed grip on the backhand is because the player needs the added strength and stability of a second hand to make an acceptable shot. The lack of strength may be due to the age (very young or elderly), sex or physical incapacity (e.g. tennis elbow) of the player. Sometimes even world class players use the two handed backhand simply because they can generate more power on the shot with two hands.

Conventional rackets however are not really suitable for hitting two-handed shots. In most cases, if a player grips a racket with two hands it is likely that his upper hand will overlap the top of the grip on the racket and fall on the shaft portion connecting the grip to the head of the racket. This makes for an uneven grip and a loss of some measure of control of the racket. In some cases because of this problem, rackets have been made in which the grip is extended up the shaft a small distance, usually 1 or at the most 2 inches. However, no other physical change of the racket is made and under normal circumstances the racket is still the conventional 27 inches in length.

However, even this racket is not satisfactory for hitting two-handed on both the forehand and the backhand side. To use such a racket in a two-handed grip for hitting a forehand shot would require changing the location and placement of both hands on the grip as the player moved between a forehand and a backhand shot, unless the player is willing to hit one of the shots cross-handed. Moving the hands on the grip is not a satisfactory alternative because of the problem of losing control of the racket particularly when the player is on the move.

Even more of a problem is the fact that a player can not normally know whether he will be hitting a forehand or backhand shot until the ball leaves his opponent's racket. Thus, he cannot make a grip selection if he is to hit a two handed shot until that time. However to make such a change of placement of the hands on the racket the player has to look at his racket rather than keeping his eye on the ball to prepare for the next shot. The timing of the game of tennis such that it is essentially impossible to take your eye off the ball after it has been hit by your opponent and still hope to hit a satisfactory return yourself.

SUMMARY OF THE PRESENT INVENTION

The present invention solves the foregoing problem by providing a racket which is significantly increased in overall length to a length of 29 inches or greater. The grip on the handle is likewise lengthened significantly from a grip that is conventionally 7 inches in length to one that is at least 9 inches in length.

The invention thus provides a sports racket comprising a frame forming a racket head connected to a handle shaft through a throat section. The racket encompasses an overall length of at least 29 inches as measured from the tip of the head along the center line of the racket to the butt of the grip. A grip portion circumscribes the handle shaft and has a length of at least 9 inches as measured from the butt of the grip to the top thereof along the shaft of the racket.

In another aspect, the invention provides a tennis racket comprising a frame having a head connected to a handle grip so as to have an overall length of 29 to 34 inches and a weight of 15 to 20 ounces. The head has a strung surface of at least 80 square inches and the grip has a length of from 9 to 12 inches to permit the racket to be used in hitting two-handed shots from either the forehand or the backhand side without changing the position of the primary hand on the grip.

By providing an elongated racket and an elongated grip a player is enabled to place his primary hand in the middle of the grip and then move his other hand above or below the primary hand in the course of moving between a forehand and a backhand two-handed shot. By providing a racket which enables a player to keep his primary hand constantly in place on the racket, the problems of having to shift both hands is eliminated and the fixed position of one hand provides an an automatic point of registration for the other hand whether this second hand is placed above or below the primary hand on the grip. The result is a racket which is the first racket truly suited for the use by players with limited physical capabilities for effectively hitting two-hand shots from either the forehand or backhand side. Thus the racket is particularly suited for use by children and players with tennis elbow or other semipermanent injury.

DESCRIPTION OF THE DRAWINGS

These and other advantages of the present invention will be better understood by reference to the drawings wherein:

FIG. 1A is a front elevation view of a racket according to the present invention held by a right-hander in a forehand grip, FIG. 1B is a front elevation of a racket according to the present invention held by a right handed player in a backhand grip, FIG. 2A is a partial elevation view of one alternate embodiment of the head of a racket according to the present invention, FIG. 2B is a partial elevation view of another alternate embodiment of the head of the racket according to the present invention, FIG. 2C is still another partial alternate embodiment of a head of a racket according to the present invention, and FIG. 3 an elevation view of racket according to the present invention provided with a alternate embodiment of the grip according to the present invention.

DESCRIPTION OF A SPECIFIC EMBODIMENT

Figure 3:
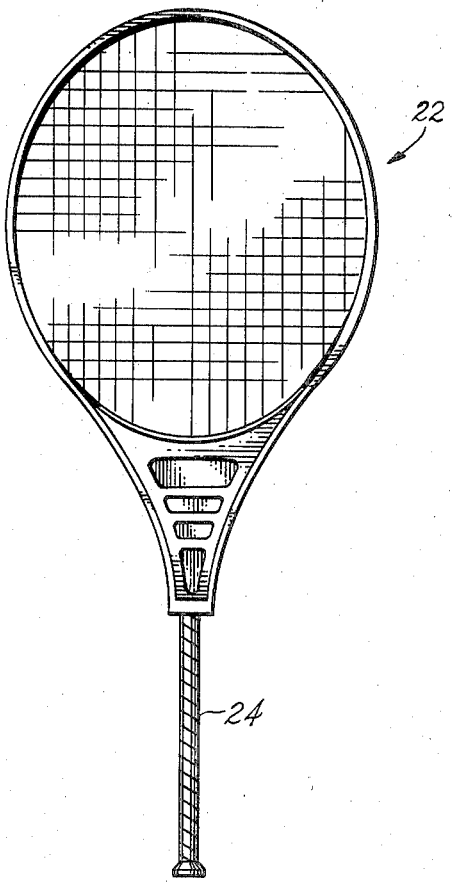

A tennis racket according to the present invention is shown in FIGS. 1A, 1B. The racket shown therein has an overall length of 29 to 34 inches and a preferred length of 30 to 32 inches. Tennis rackets and other sports rackets having a length in excess of 34 inches are also contemplated. Tennis rackets of such lengths may also require the addition of weighting (removable or permanent) in the head to control the location of the balance point. The weight of the racket is in the range 15 to 21 ounces and its preferred weight is in the range 17 to 18 ounces. For children a tennis racket approximately 30 inches in length is preferred; for women, approximately 31 inches, and for men, approximately 32 inches. The racket according to the present invention is suitable for use with racket heads of various sizes ranging from a size larger than the enlarged size which is described and claimed in U.S. Pat. No. 3,999,756 to the conventional sizes and other sizes intermediate this range.

The length of the grip of the racket according to the present invention is 9 to 14 inches with a preferred length as measured from the butt of the handle of 12 to 13 inches. In addition to utilizing a grip with a circumference of the conventional tennis racket dimension of between 4 and 5 inches, the present invention also contemplates the use of a handle which is considerably smaller in circumference in the range of 1 to 4 inches, similar to the handle used on a golf club shaft. This latter type of handle is made practical by the fact that the racket is gripped by two hands for all shots (including the serve) and a player has available to him the strength of both hands when gripping the racket to enable him to resist the twisting and turning forces which are experienced particularly when a ball is struck off center.

The advantages of such a racket are several and include elimination of tennis elbow and related injuries, significantly reduced strain on hands and arms when hitting and reduction of the time to learn the game of tennis, squash or the like. Since people generally feel more comfortable using two hands, the mechanics of the game are picked up more rapidly. Childen and people taking up the game late in life are particularly benefitted by the use of such a racket.

The illustrations of FIGS. 1A and 1B show the racket according to the present invention held by a right-handed player. In FIG. 1A is illustrated the grip that the player utilizes when hitting a forehand shot with two hands. As seen therein the racket 10 is held by the right hand of the player 12 which is positioned essentially in the middle of the grip leaving a length of grip between the right hand and the butt approximately equal to the amount of grip above the right hand to the uppermost point thereof. When hitting a forehand shot, a right-hand player would place his left hand 14 on the grip below the right hand as is shown in ghosted outline in FIG. 1A.

In the course of play as the player is required to hit a backhand shot, the racket 10 is brought to the left side of the player's body if he is a right-hander and his right hand 12 remains in place on the racket in the same location as shown in FIG. 1A. In this event, however, the left hand is removed from the lower portion of the racket and placed above the right hand between the right hand and the upper portion of the grip. A right-handed player is thus in a position to hit a two-handed backhand shot with the racket without taking his eye off the ball since the right hand serves to guide and register the left hand on the grip by "feel". The racket according to the present invention providing as it does a tennis racket which is 29 to 34 inches in overall length has the added advantage of aiding a player on hitting a two handed backhand shot by providing the player with a longer effective reach on the backhand side in comparison to a conventional racket shot with a two hand backhand.

In general the length of the grip is equal to three handwidths of the player using it. For men, this length is approximately 12 inches; for women, 11 inches and for children, 10 inches.

The racket head shown in FIGS. 2A, 2B, and 2C illustrate the difference types of racket heads that may be used with the present invention. As shown in FIG. 2A an enlarged racket head 16 of 112 square inches such as that shown in U.S. Pat. No. 3,999,756 is suitable for use with the present invention. Likewise the conventional size head 18 of approximately 80 square inches shown in FIG. 2B is equally useful and results in a racket when constructed according to the dimensions of the present invention having a handle which is approximately 15 inches in length as measured from the butt to the beginning of the throat of the racket. Finally, in FIG. 2C a racket head 20 is shown which is larger than 112 square inches and effectively makes the length of the handle of the racket 13 to 14 inches in length as measured from the butt to the throat of the racket.

An alternate embodiment of the racket according to the present invention is shown in FIG. 3. As can be seen from the illustration in FIG. 3, a racket 22 has a grip 24 of a circumference significantly smaller than the grip of the racket shown in FIGS. 1A and 1B and is in the range of 1 to 4 inches in circumference. The handle resembles, in the structure, the grip of a golf club. No loss of control of the racket is experienced when using such a grip on a two-handed racket because the player is able to grip the racket with both hands and resist any twisting or turning forces which are experienced when hitting the tennis ball off center. By reducing the circumference of the grip from 4 to 5 inches to a dimension in the range of 1 to 4 inches, more control of the racket is achieved and the player is enabled to put more "wrist" into his shots because the bulk of the grip has been substantially reduced.

What is claimed is:

1. A tennis racket comprising a frame having a head connected to a handle shaft through a throat section so as to have an overall length of 30 to 32 inches and a weight of 15 to 21 ounces, said head having strung surface of 80 to 130 square inches, and a grip located on the handle portion of the racket, said grip having an overall length of at least 3 adult handwidths such that the racket can be gripped in the middle of the grip by one hand have sufficient space to place the other hand either above or below the first hand to permit the racket to be grasped in a two-handed grip when hitting either a forehand or a backhand shot.

2. A tennis racket comprising:

an oval open head having a plurality of intersecting strings extending across the open area within the perimeter of the head, said head being flat on both sides thereof to permit striking a tennis ball with either side of the sqriking surface;

an elongated handle having a length approximately 50% greater than the length of conventional tennis racket handles;

a throat section interconnecting the head and handle shaft, the head, handle and throat section combined having an overall length of 30 to 32 inches and a weight of 18 to 21 ounces; and a three-handed grip located on and covering the handle portion of the racket below the throat section without encroaching thereon;

said grip having an overall length at least equal to three times the width of the average adult hand, said grip further having a primary hand section located intermediate the ends of the grip and an upper and a lower secondary hand section, said upper secondary section being located between the upper end of the grip and the primary hand section and said lower secondary section being located between the lower end of the grip and the primary hand portion such that the racket can be gripped at the primary hand section of the grip by a first hand of a player and have sufficient space on the grip to permit the player to grip the racket with the other hand at the upper or lower secondary hand portion so as to permit the racket to be grasped in a two-handed grip when hitting either a forehand or backhand shot without moving the placement of the first hand from the primary hand section on the grip and without the necessity of rotating the racket about its longitudinal axis to present the same striking surface in executing the forehand and backhand strokes.

3. A tennis racket according to claim 2 including at least one weighting element removably attached to the head of the racket for adjusting the location of the balance point of the racket.

* * * * *